US008150094B2

(12) United States Patent
Ando

(10) Patent No.: US 8,150,094 B2
(45) Date of Patent: Apr. 3, 2012

(54) ELECTROACOUSTIC TRANSDUCER

(76) Inventor: Yukihiro Ando, Nagano (JP)

( * ) Notice: Subject to any disclaimer, the term of this patent is extended or adjusted under 35 U.S.C. 154(b) by 938 days.

(21) Appl. No.: 12/216,549

(22) Filed: Jul. 8, 2008

(65) Prior Publication Data

US 2009/0147984 A1 Jun. 11, 2009

(30) Foreign Application Priority Data

Dec. 7, 2007 (JP) ..... 2007-317491

(51) Int. Cl.
*H04R 1/00* (2006.01)

(52) U.S. Cl. ..... 381/396; 381/114; 381/173; 381/190; 381/337; 381/338; 381/339; 381/354

(58) Field of Classification Search ..... None
See application file for complete search history.

(56) References Cited

U.S. PATENT DOCUMENTS

2007/0041604 A1* 2/2007 Yang ..... 381/370

FOREIGN PATENT DOCUMENTS

| | | | |
|---|---|---|---|
| EP | 1748672 | * | 1/2007 |
| JP | 01-252700 | A | 10/1989 |
| JP | 07-059186 | A | 3/1995 |
| JP | 2000-083297 | A | 3/2000 |
| JP | 2000-308177 | A | 11/2000 |
| JP | 2003-163999 | A | 6/2003 |
| JP | 2005-260901 | A | 9/2005 |
| JP | 2005-303601 | A | 10/2005 |

* cited by examiner

*Primary Examiner* — Charles Garber
*Assistant Examiner* — Yasser Abdelaziez
(74) *Attorney, Agent, or Firm* — Radner, Fishman & Grauer PLLC

(57) ABSTRACT

An electroacoustic transducer comprises an electric sound conversion section that vibrates a mechanical device based on an electric signal so as to emit a sound wave; and an electromagnetic wave radiation section that generates and emits an electromagnetic wave from the electrical signal.

20 Claims, 5 Drawing Sheets

ELECTROACOUSTIC TRANSDUCER

CROSS-REFERENCES TO RELATED APPLICATION

The disclosure of Japanese Patent Application No. 2007-317491, filed Dec. 7, 2007, including its specification, claims and drawings, is incorporated herein by reference in its entirety.

TECHNICAL FIELD

Described herein is an electroacoustic transducer and specifically to an electroacoustic transducer for emitting an acoustic signal which is a sound wave converted from an electrical signal, and an acoustic signal which is an electromagnetic wave converted from the electrical signal.

BACKGROUND

In a conventional electroacoustic transducer, in order to reproduce, with high quality, a wide band of a sound from a sound source as precisely as possible, various technical developments are in progress. Specifically, the bandwidth has been expanded from audio frequency to an ultrasonic band in order to reduce a sound conversion loss. In addition, various distortions in the band have been reduced. Further, an impulse response has been improved. Moreover, phase distortions, etc. have been adjusted.

For example, Japanese Laid Open Patent No. 2000-308177 discloses a ring shaped diaphragm having a V-character shape in a cross-sectional view thereof, taken along a circumferential direction of both ends of a cylindrical bobbin, on which a voice coil is winded, wherein both ends of the V-character shape are free. And further it discloses a speaker unit in which treble sound can be produced by piston vibration of the diaphragm, and super-treble sound can be produced in shape of a wave by differential vibration at the end portions of the diaphragm.

Moreover, Japanese Laid Open Patent No. H07-59186 discloses a method and apparatus for compensating a linear distortion of an acoustic signal in which linear distortion of the acoustic signal produced from a speaker system is compensated at a high frequency resolution in a low frequency band, and is compensated at a relatively low frequency resolution in a RF band since there is hearing property of the human beings who tends to feel a frequency change of an acoustic signal better as it is at a lower frequency, and it is hard to feel a frequency change at a higher frequency.

Furthermore, Japanese Laid Open Patent No. H11-252700 discloses that in an acoustic apparatus which uses a space in a car as a sound field, a phase property to the acoustic signal reproduced in the acoustic apparatus is adjusted.

The premise common to such technical developments is the mechanism of radiation of a sound wave in that sound is generated by dilatational wave (longitudinal wave) in which vibration is propagated in the air. In other words, the electroacoustic transducer in which mechanical vibration system inserted between an electrical signal and an acoustic signal (dilatational wave) is focused.

However, it is certain that vibrations generated in the nature are not limited to such dilatational wave (longitudinal wave). For example, in a familiar example, vibration of the bowstring of a violin is said to be a traverse wave.

On the other hand, the feeling of those who feel sound is called hearing or acoustic sense, in that an acoustic signal which enters in human's ears vibrates eardrums, and the vibration reaches a cerebrum center through a semicircular canal and a cochlear nerve. However, the mechanism of human's acoustic treatment capacity is still unknown in many fields.

SUMMARY

In view of such background, in the process of researches and developments of "Ultra Sound Technology" which led to International Patent Application No. PCT/JP 2005/008999, the inventor came to imagine existence of an audible electric wave (audible electromagnetic wave). The research was advanced, bearing in mind the image of this audible electric wave. When a loop was provided on the transmission path of an electrical signal of an electroacoustic transducer, and a signal source was reproduced, a difference in the quality of the reproduced sound was recognized by the existence of the loop. When a person having difficulty in hearing listened to this reproduced sound, it was audible well. Thus, existence of the audible electromagnetic wave which affects human's acoustic treatment capacity is confirmed, thereby resulting in the present invention.

Described herein is an electroacoustic transducer capable of realizing an audible electromagnetic wave which is considered to affect human's acoustic treatment capacity.

The present electroacoustic transducer comprises an electric sound conversion section and an electromagnetic wave radiation section. The electric sound conversion section vibrates a mechanical system based on an electrical signal, so that a sound wave may be generated and emitted. The electromagnetic wave radiation section generates and radiates (emits) an electromagnetic wave from the electrical signal.

Here, a sound wave is a longitudinal wave generated by the dilatational wave of air, and means wave motion in which a direction of vibration is the same as that of movement of the wave. On the other hand, an electromagnetic wave is a wave motion, which is transmitted in the space with an electric field or a magnetic field by turning an electric field into a magnetic field, or a magnetic field into an electric field, and in which a direction of vibration is perpendicular to a direction of movement of a wave. The process in which an electrical signal is changed into vibration by a mechanical diaphragm is indispensable to generate the sound wave in the electric sound conversion section. However, it is difficult to change an electrical signal into a sound wave precisely.

For example, phase distortion tends to be produced because the compatibility etc. of the frequency of an electrical signal, and the resonant frequency of a diaphragm. On the other hand, an electromagnetic wave generated in the electromagnetic wave radiation section has characteristics in that an electrical signal is directly converted into an acoustic signal without a mechanical system. Although property of a sound wave and that of an electromagnetic wave differ from each other, it is assumed that there is an effect that the electromagnetic wave generated by the electromagnetic wave radiation section enhances human's acoustic treatment capacity. In view of the feeling of human's hearing, in the sound generated by the electroacoustic transducer according to the present invention, it can be considered that an electromagnetic wave sticks with (follows) the sound wave of the electric sound conversion section. When the Applicant heard a sound produced by collecting the acoustic signal from the electromagnetic wave radiation unit according to the present invention with a bar antenna, and by inputting it into the microphone terminal, the Applicant confirmed a clear sound in which the phase is not out of order. However, when the sound from a speaker unit was collected with the bar antenna and was heard in a similar way, it was confirmed that the sound was very indistinct and fuzzy sound. The sound wave produced by an electroacoustic transducer, and the electromagnetic wave produced by the electromagnetic wave radiation section have relation in that an electromagnetic wave supplements, or covers the quality of the sound wave (clear sound without the phase difference). This shows that the electromagnetic wave radiation section is useful to not only a healthy person but also a person having difficulty in hearing. Although the electromagnetic wave is deemed to be a wave which is not felt in human's senses, the acoustic signal in form of an electromagnetic wave and the acoustic signal in form of a sound wave are superimposed in human's hearing, so that an audible electromagnetic wave is obtained.

BRIEF DESCRIPTION OF THE DRAWINGS

Other features and advantages of the present electroacoustic transducer will be apparent from the ensuing description, taken in conjunction with the accompanying drawings, in which.

DESCRIPTION

A description will now be given, referring to embodiments of the present electroacoustic transducer. While the claims are not limited to such embodiments, an appreciation of various aspects of the present electroacoustic transducer is best gained through a discussion of various examples thereof.

In order to improve human's acoustic treatment capacity, an electroacoustic transducer according to the embodiment has an electromagnetic wave radiation section which generates an electromagnetic wave based on an electrical signal and which is connected to an arbitrary part of a signal transmission path through which an electrical signal is transmitted to a mechanical system from a signal source side.

Figure 1:
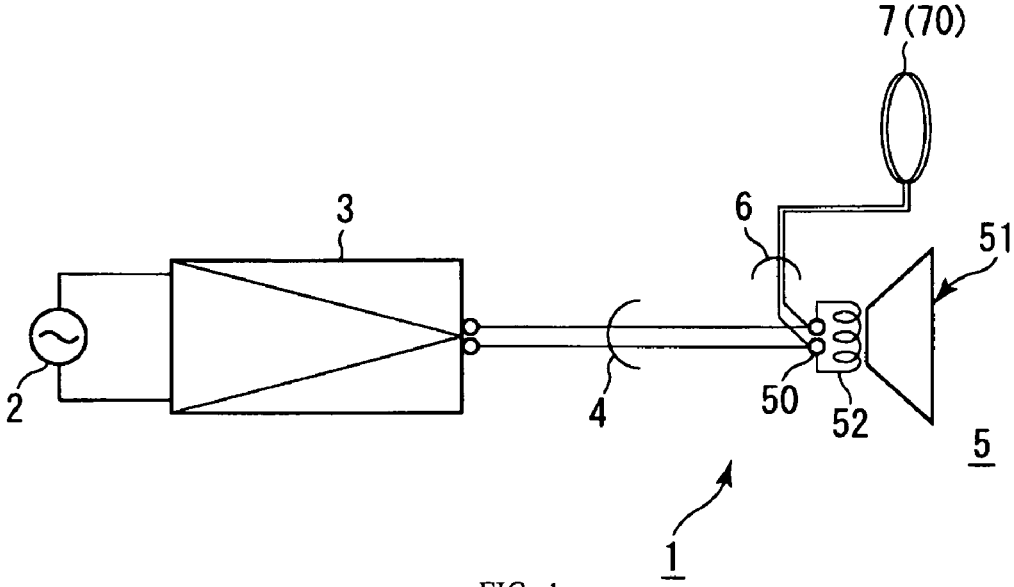
FIG. 1 shows an electroacoustic transducer according to a first embodiment.
Figure 2:
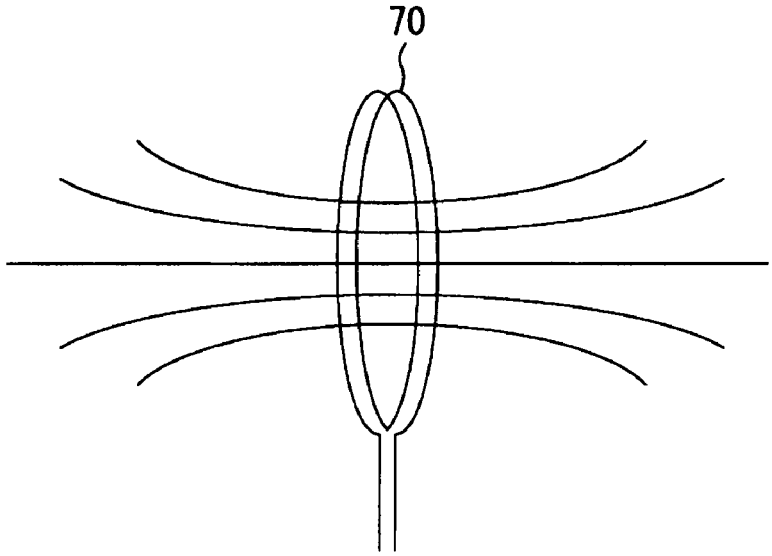
FIG. 2 is an explanatory view of a loop type antenna used for an electroacoustic transducer.

Embodiments of the electroacoustic transducer are described below, referring to the drawings. FIG. 1 shows the structure of an electroacoustic transducer according to the first embodiment. FIG. 2 is an explanatory diagram of a loop type antenna as an electromagnetic wave radiation section which forms the electroacoustic transducer. FIGS. 3A-3E show modified examples of an antenna as the electromagnetic wave radiation section. FIGS. 4A-4D are schematic views of an earphone, a headphone, and a speaker. In addition, in above-described figures, the same reference numerals are assigned to the same structural elements, and therefore, overlapped explanation thereof is omitted.

The electroacoustic transducer 1 according to the first embodiment, includes a signal transmission path 4 through which an electrical signal amplified by an amplifier 3 from a signal source 2 is transmitted, an electric sound conversion section 5 which emits a sound wave based on the electrical signal transmitted from the transmission path 4, and an antenna power supply path 6 connected in parallel with an input terminal 50 of the electric sound conversion section 5, and a loop type antenna 70 as an electromagnetic wave radiation section 7 which generates and radiates (emits) an electromagnetic wave based the electrical signal of the supply path 6.

The electric sound conversion section 5 is made up of a speaker unit 51 which is an electrodynamic type, electromagnetism type, piezo-electric type, or electrostatic type. In this embodiment, the electrodynamic speaker is used.

In the loop type antenna 70, the starting point (antenna terminal) of the antenna power supply path 6 is connected in parallel with the input terminal 50 of the voice coil 52 of the speaker unit 51. By such connection structure, there is an effect that the electroacoustic transducer 1 can be compactly accommodated in one casing etc.

Figure 3A:
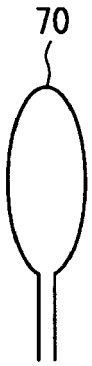
FIGS. 3A-3E shows modified examples of antenna used for an electroacoustic transducer.
Figure 3B:
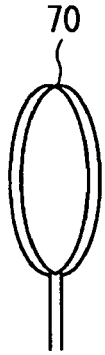
Figure 3C:
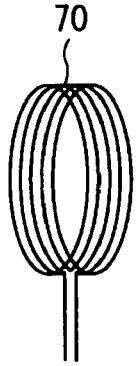
Figure 3D:
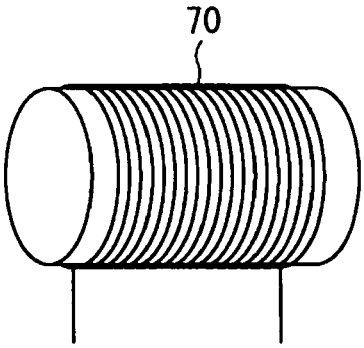

It is sufficient if the number of loops of the loop type antenna 70 is at least one (1 turn), as shown in FIG. 3A, and the number of loops is not limited to that shown in FIG. 3A (refer to FIG. 3B-3D).

Figure 3E:
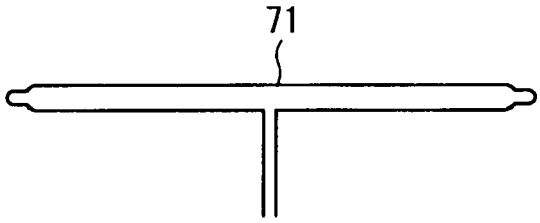

Moreover, the antenna 70 may have an air core as shown in FIG. 3A-3C, or, as shown in FIG. 3D, the loop may be formed on the core. If a ferrite core having high permeability etc. is used, electromagnetic wave radiation efficiency can be raised. Furthermore, as shown in FIG. 3E, a dipole type antenna 71 may be used.

The position of these antennas 70 and 71 is set so that the radiation direction of the electromagnetic wave and the direction of movement of the sound wave which the speaker unit 51 emits may be in agreement. Thereby, advantage of the directivity of the electromagnetic wave of the antennas 70 and 71 can be taken.

On the other hand, without making the radiation direction of an electromagnetic wave and the direction of movement of the sound wave in agreement with each other, the arrangement position of antennas 70 and 71 may be made adjustable so that the sound quality and sound field can be adjusted according to listeners' preference. This is suitable in case the antennas 70 and 71 are arranged outside the casing of the speaker etc., as illustrated in FIG. 4D described below.

Next, an operation of the electroacoustic transducer 1 will be described below. In the electroacoustic transducer 1, when an audio reproduction device in which the signal source 2 and the amplifier 3 are built is turned on, an electrical signal is supplied to the speaker unit 51 and the loop type antenna 70. The electrical signal (alternating current) supplied to this loop type antenna 70 generates and emits the acoustic signal which is an electromagnetic wave, forming electric flux lines and magnetic field lines as shown FIG. 2. The electromagnetic wave propagates in the space at the velocity of light, and the acoustic signal in form of the electromagnetic wave stimulates human's hearing. Following this, the speaker unit produces a sound based on the same electrical signal, and human's hearing is stimulated so that the acoustic signal in form of the sound wave may follow the acoustic signal in form of the electromagnetic wave. Although the electromagnetic wave is deemed as a wave which is not sensed by human's senses, it turns out as if the acoustic signal in form of a sound wave was superimposed on the acoustic signal in form of an electromagnetic wave by human's hearing. The acoustic signal of such an electromagnetic wave is referred to hereinafter as an audible electric wave (audible electromagnetic wave).

Figure 4A:
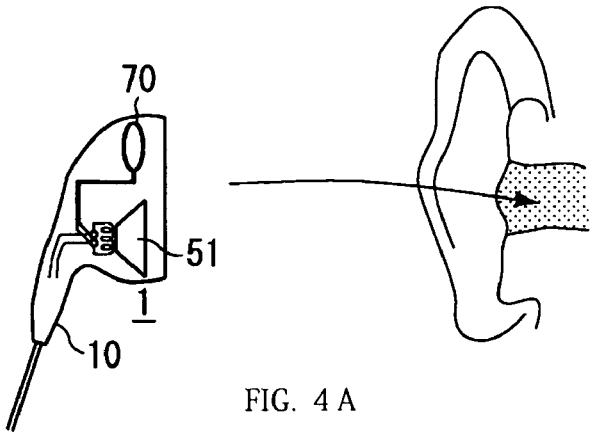
FIGS. 4A-4D are schematic views showing an earphone, a headphone, and a speaker, using an electroacoustic transducer.
Figure 4D:
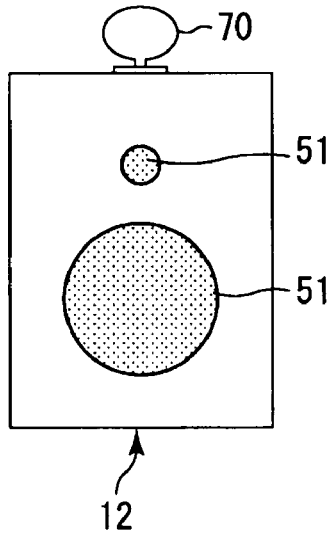
Figure 4B:
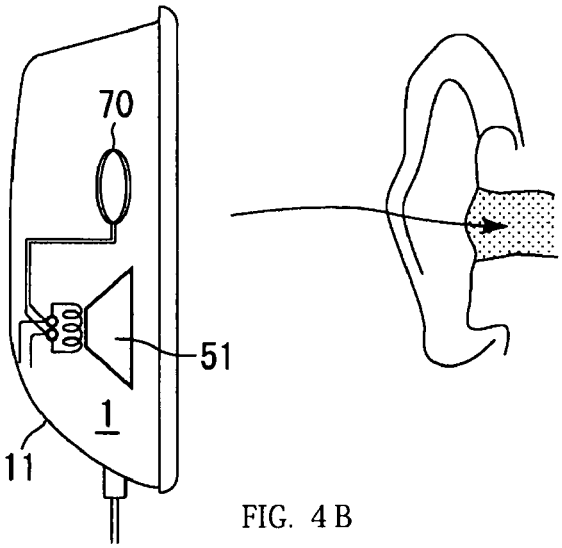
Figure 4C:
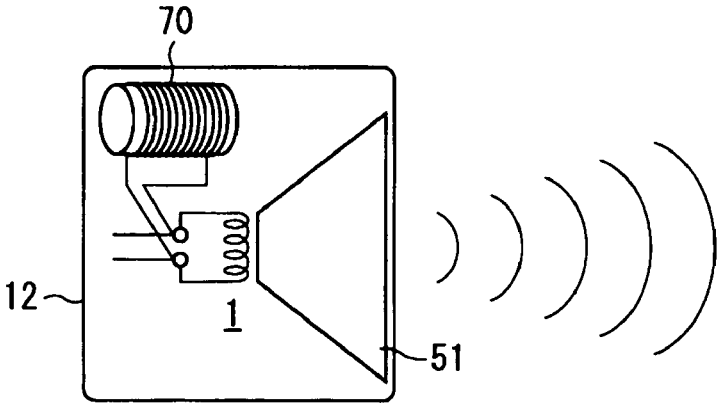

The electroacoustic transducer 1 formed as described above, is accommodated and assembled, with the speaker unit 51 in the casing of an earphone 10, a headphone 11, or a speaker 12, as shown in FIGS. 4A-4C. In addition, the antennas 70 and 71 may be arranged outside the casing of the unit of the earphone 10, the headphone 11, or the speaker 12. For example, as to the speaker 12, the antenna 70 is arranged on an upper face of the casing (enclosure), as shown in FIG. 4D. Moreover, the electromagnetic wave radiation section 7 may not be limited to the linear shape loop type antenna 70 etc., and for example, an opening face antenna etc. may be used therefor.

The effects of the electroacoustic transducer 1 are summarized below.

(a) An acoustic signal in form of an electromagnetic wave, and an acoustic signal in form of a sound wave are superimposed in human's hearing, so as to become an audible electric wave, and natural sound elements which reproduced sound in form of only a sound wave lacks are expressed. Consequently, the naturalness of reproduction sound and the degree of reality can be increased, and audio information with little transfer loss can be obtained from the signal source. That is, the reproduced sound can be naturally felt with nuance like a feeling of a sign of presence, or presence feeling due to an acoustic signal in form of the electromagnetic wave and the acoustic signal in form of a sound wave.

(b) Such sound can be effectively used for not only a healthy person but also a hearing-impaired person.

(c) An audio transfer distance can be extended even though it is a small voice output.

(d) It is possible to form an orderly sound environment without mixing two or more audio outputs.

(e) Since the antenna power supply path 6 of the loop type antenna 70 is connected in parallel with the input terminal 50 of the voice coil 52, the electroacoustic transducer 1 can be accommodated in one casing etc., thereby forming a simple structure.

Figure 5A:
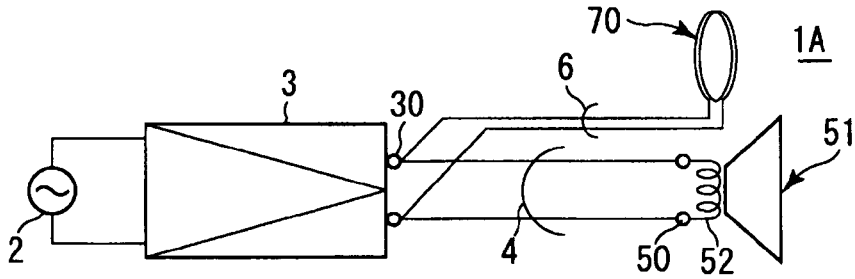
FIGS. 5A-5E show the structure of an electroacoustic transducer according to second to six embodiments.

Next, referring to FIG. 5A, a second embodiment of an electroacoustic transducer 1A will be described below. This electroacoustic transducer 1A is different from the electroacoustic transducer 1 in that while the antenna terminal is in parallel connected with the input terminal 50 of the voice coil 52 in the electroacoustic transducer 1, in the electroacoustic transducer 1A, an antenna terminal is in parallel connected with an output terminal 30 of an amplifier 3. The other structural elements and effects thereof are the same as those of the electroacoustic transducer 1 according to the first embodiment.

Figure 5B:
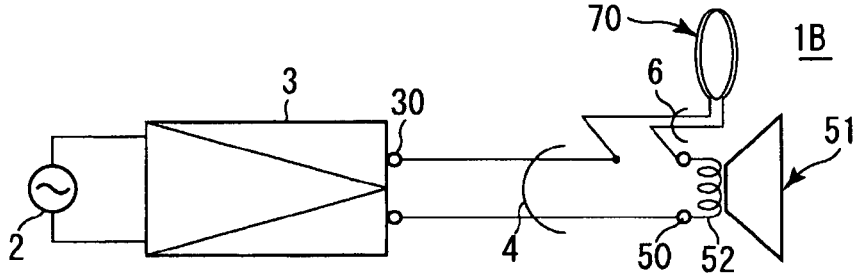
Figure 5C:
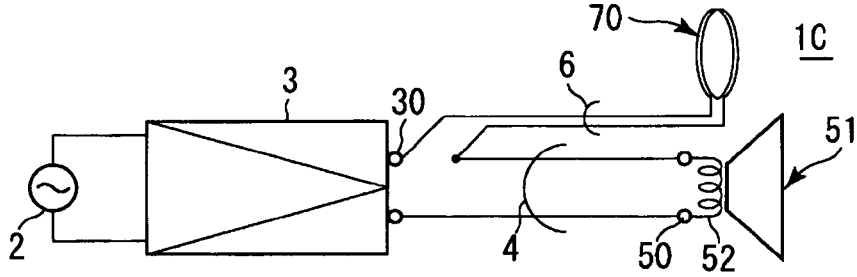

Next, referring to FIG. 5B and FIG. 5C, an electroacoustic transducer 1B according to a third embodiment and an electroacoustic transducer 1C according to a fourth embodiment will be described below.

The electroacoustic transducers 1B and 1C according to the third and fourth embodiments are differ from those of the first and second embodiments, in that while in the first and second embodiments, the antenna terminal is in parallel connected with the signal transmission path 4, in the third and fourth embodiments, an antenna terminal is in series connected with the signal transmission path 4. The antenna terminal is connected to an input terminal 50 side of a voice coil 52 in the electroacoustic transducer 1B. The antenna terminal is connected to the output terminal 30 side of an amplifier 3 in electroacoustic transducer 1C. The other structural elements and effects thereof are the same as those of the electroacoustic transducer according to the above-described embodiments.

Figure 5D:
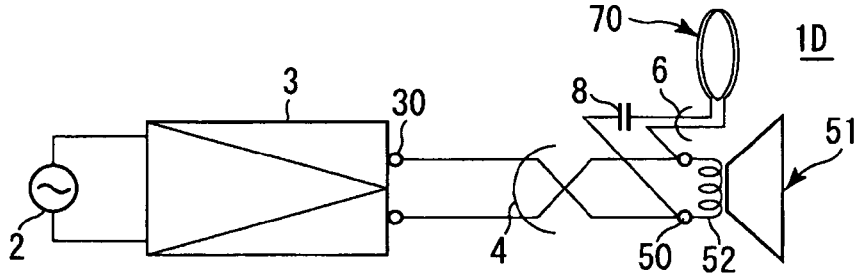
Figure 5E:
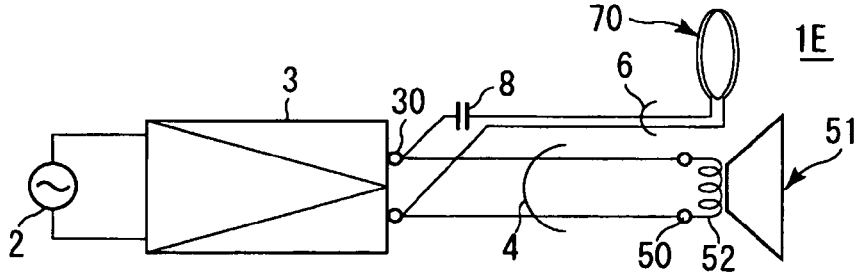

Next, referring to FIGS. 5D and 5E, an electroacoustic transducer 1D according to a fifth embodiment and an electroacoustic transducer 1E according to a sixth embodiment will be described below.

In the electroacoustic transducer 1D, a low cut-off filter 8 is inserted in an antenna power supply path 6 of the above-described electroacoustic transducer 1. Moreover, in the electroacoustic transducer 1E, a low cut-off filter 8 is inserted in the signal transmission path 6 of the above-described electroacoustic transducer 1A. In this case, the low cut frequency can be changed, so as to adjust the sound quality, sound field, etc., and the supported supply voltage to an antenna 70 is increased. Moreover, since the electromagnetic wave of frequency higher than the set value is generated by the low cut-off filter 8, it is possible to emit the acoustic signal with high frequency which is considered as hard to be listened to by the person having difficulty in hearing, compared with a healthy person. In addition, without limiting to the low cut-off filter 8, a filter having a various set value can be arranged according to use of the electroacoustic transducer. Other structural elements and effects are the same as those of the electroacoustic transducer according to each embodiment.

Figure 6:
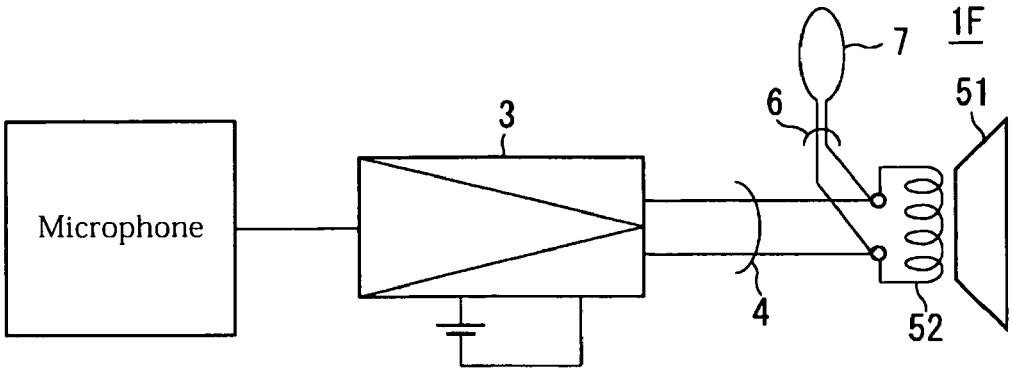
FIG. 6 is a block diagram in case the electroacoustic transducer according to the first embodiment is used in a hearing-aid.

Although the electroacoustic transducer is used for an earphone, a headphone, a speaker, etc., it can be also used for a hearing-aid. The hearing-aid 1F may be made up of a microphone, an amplifier 3, a power supply therefor, a signal transmission path 4, a speaker unit 51, an antenna power supply path 6, and a loop type antenna 70 as shown in FIG. 6. The other structural element and effects thereof are the same as those of the electroacoustic transducer according to above-described embodiments.

Figure 7:
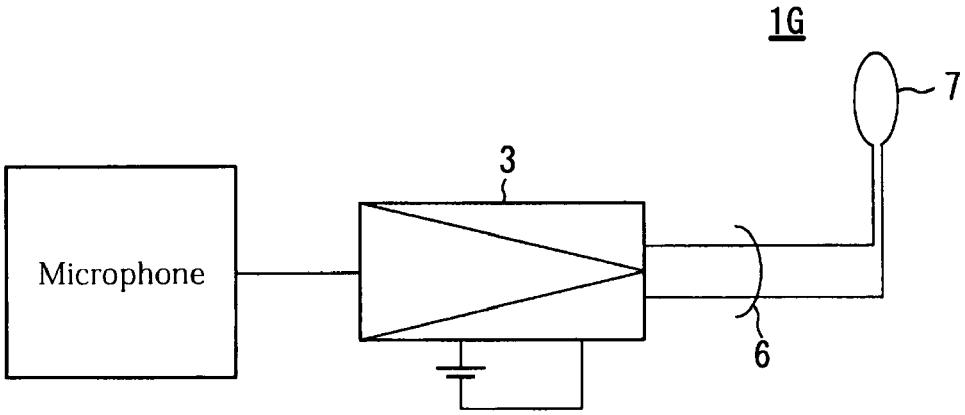
FIG. 7 is a block diagram showing the structure of a hearing aid device formed by an electromagnetic wave radiation section.

Moreover, in view of paying attention to the operation of the electromagnetic wave radiation section 7, "a hearing aid device" may be constructed as illustrated in FIG. 7. The hearing aid device 1G is made up of a microphone which converts a sound into an electrical signal, an amplifier 3 which amplifies the electrical signal inputted from the microphone, a power supply therefor, an antenna power supply path 6, and a loop type antenna 70. The hearing aid device 1G is arranged on, for example, a table in front of a person having difficulty in hearing etc., and is used as an auxiliary apparatus for conversation. That is, when sound is an audio, as if the sound wave and the acoustic signal in form of the electromagnetic wave emitted from the antenna 70 are superimposed in human's hearing, the sound can be effectively used for a hearing-impaired person. The other structural elements and effects thereof are the same as those of the electroacoustic transducer according to the above-described embodiments.

The preceding description has been presented only to illustrate and describe exemplary embodiments of the present electroacoustic transducer. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An electroacoustic transducer comprising:

an electric sound conversion section that vibrates a mechanical device based on an electric signal so as to emit a sound wave; and an electromagnetic wave radiation section that generates and emits an electromagnetic wave from the electrical signal, wherein the electromagnetic wave radiation section is arranged so that a radiation direction of the electromagnetic wave and a direction of movement of the sound wave is in agreement.

2. The electroacoustic transducer according to claim 1, wherein the electromagnetic wave radiation section is a loop type antenna.

3. The electroacoustic transducer according to claim 1, wherein the electromagnetic wave radiation section is a dipole type antenna.

4. The electroacoustic transducer according to claim 2, wherein the loop type antenna is connected in parallel to a signal transmission path between a signal source and the electric sound conversion section.

5. The electroacoustic transducer according to claim 3, wherein the loop type antenna is connected in series to a signal transmission path between a signal source and the electric sound conversion section.

6. The electroacoustic transducer according to claim 3, wherein the dipole type antenna is connected in parallel to a signal transmission path between a signal source and the electric sound conversion section.

7. The electroacoustic transducer according to claim 3, wherein the dipole type antenna is connected in series to a signal transmission path between a signal source and the electric sound conversion section.

8. The electroacoustic transducer according to claim 2, wherein the number of loops of the loop type antenna is at least one.

9. The electroacoustic transducer according to claim 3, wherein the number of loops of the dipole type antenna is at least one.

10. The electroacoustic transducer according to claim 2, wherein the loop type antenna is wound around a core.

11. The electroacoustic transducer according to claim 3, wherein the dipole type antenna is wound around a core.

12. The electroacoustic transducer according to claim 4, wherein the loop antenna is connected in parallel to the signal transmission path through a filter.

13. The electroacoustic transducer according to claim 6, wherein the dipole antenna is connected in parallel to the signal transmission path through a filter.

14. The electroacoustic transducer according to claim 1, wherein the electric sound conversion section is a speaker unit which is provided in a casing of a headphone or earphone.

15. The electroacoustic transducer according to claim 1, wherein the electric sound conversion section is a speaker unit which is provided in a casing of an hearing-aid.

16. The electroacoustic transducer according to claim 1, wherein the electric sound conversion section is a speaker unit which is provided in a casing of a speaker.

17. The electroacoustic transducer according to claim 1, wherein the electric sound conversion section is a speaker unit which is provided on a casing of a headphone or earphone.

18. The electroacoustic transducer according to claim 1, wherein the electric sound conversion section is a speaker unit which is provided on a casing of an hearing-aid.

19. The electroacoustic transducer according to claim 1, wherein the electric sound conversion section is a speaker unit which is provided on a casing of a speaker.

20. An electroacoustic transducer comprising:

an electric sound conversion section configured to emit a sound wave based on an electric signal; and an electromagnetic wave radiation section configured to emit an electromagnetic wave based on the electrical signal, the electromagnetic wave radiation section principally emitting the electromagnetic wave in substantially the same direction as the sound wave.

* * * * *